US005753103A

United States Patent [19]

Transfeld et al.

[11] Patent Number: 5,753,103

[45] Date of Patent: May 19, 1998

[54] METHOD AND APPARATUS FOR ADSORPTIVE CLEANING OF SUBSTANCES

[75] Inventors: Peter Transfeld; Matthias Schneider, both of Magdeburg; Gunter Börner, Langenweddingen, all of Germany

[73] Assignee: OHMI Forschung und Ingenieurtechnik GmbH, Magdeburg, Germany

[21] Appl. No.: 862,829

[22] Filed: May 23, 1997

[30] Foreign Application Priority Data

Mar. 23, 1996 [DE] Germany ..... 196 20 695.2

[51] Int. Cl.[6] ..... C10G 25/00

[52] U.S. Cl. ..... 208/303; 208/299

[58] Field of Search ..... 208/303, 299

[56] References Cited

U.S. PATENT DOCUMENTS 5,342,508 8/1994 Transfeld .

FOREIGN PATENT DOCUMENTS 41 24 331 C2 11/1993 Germany .

*Primary Examiner*—Gary Geist
*Assistant Examiner*—Jafar Parsa
*Attorney, Agent, or Firm*—Salter & Michaelson

[57] ABSTRACT

In a method and apparatus for adsorptive cleaning of vegetable and/or mineral oils and fats operating by a multi-stage countercurrent process, in which uncleaned oil is fed to a first stage, where it is put into contact and pre-cleaned with an already used and partly loaded adsorptive agent, fed to a first separating stage, put into contact with fresh adsorptive agent at a second stage, and then fed to a second separating stage and in which the constituents removed from the oil at the second separating stage are re-utilised at the first step in the process, as an already used, partly loaded adsorptive agent, these constituents are obtained and/or prepared as a pumpable sludge and passed to the uncleaned oil in the first stage with air excluded.

14 Claims, 1 Drawing Sheet

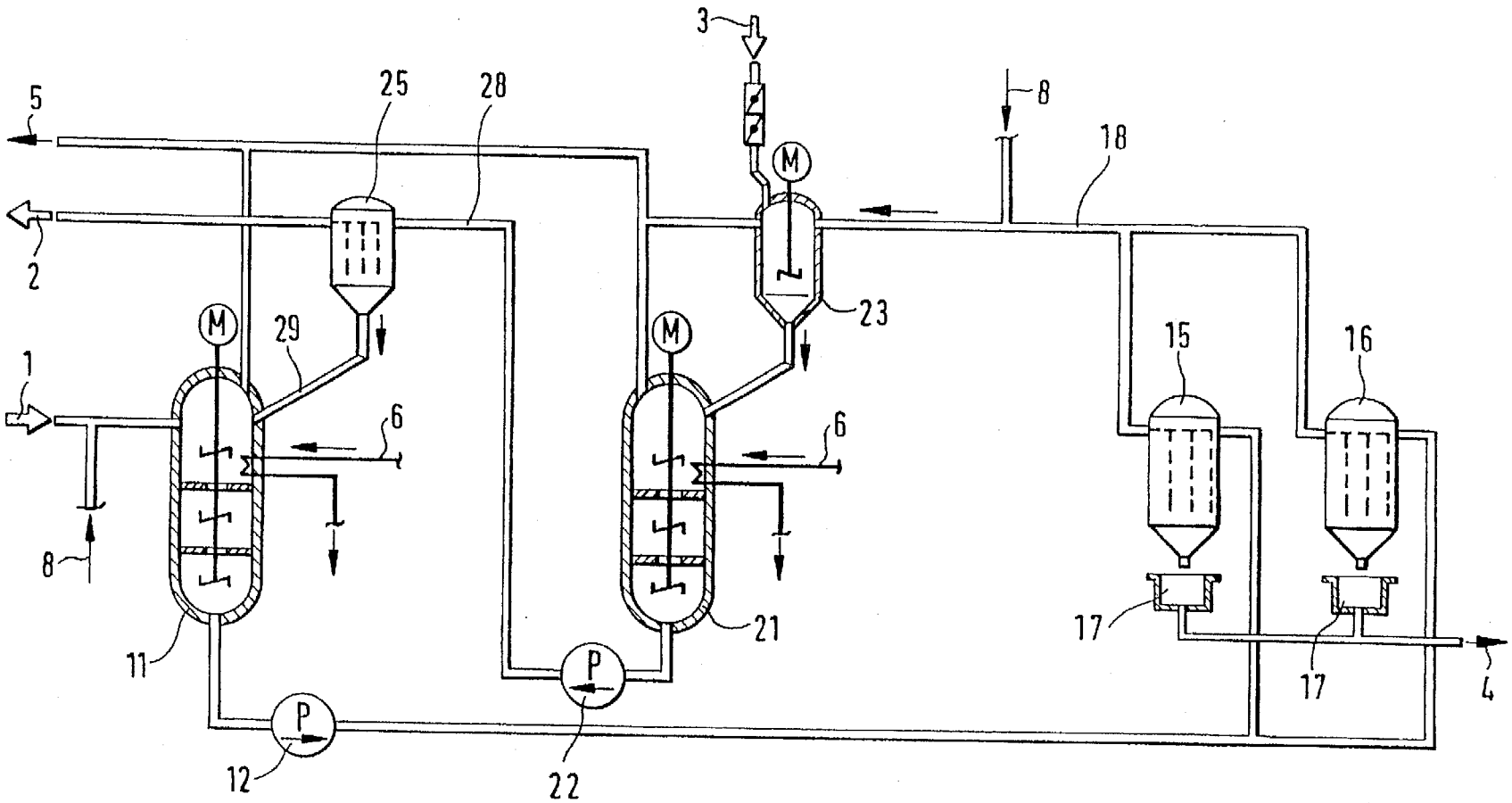
4
16
17
15
17
18
8
23
6
3
M
21
M
P
22
28
25
6
29
P
12
M
11
8
5
2
1

METHOD AND APPARATUS FOR ADSORPTIVE CLEANING OF SUBSTANCES

BACKGROUND OF THE INVENTION

The invention relates to a method and an apparatus for adsorptive cleaning of substances, especially vegetable and/or mineral oils and/or greases and/or fats, in a multi-stage counter-current process.

Such methods and apparatus are known, for example, from German Patent Document 41 24 331 C2.

The raw material, e.g. the uncleaned oil or fat, is first fed to a first stage in which it is put into contact with already used, partly loaded or charged adsorptive agent. The substance thus contacted and pre-cleaned is separated at a first separating stage, the adsorptive agent is removed from the process, and the already partly cleaned and/or bleached oil or fat remains in the process. It is now put into contact with fresh adsorptive agent which is brought into the process from outside. This procedure takes place at a second stage. This mixture of contacted fresh adsorptive agent and pre-cleaned oil or fat removes substantially the last unwanted accompanying substances from the oil or fat and is fed to a second separating stage. The second separating stage only allows the fully cleaned oil or fat to pass through.

This second separating stage thus retains the contained adsorptive agent and the other constituents taken up thereby. The adsorptive agent—this is the main idea of a counter-current system—is to be added to the uncleaned oil at the first stage, as it is only partly loaded and can still fulfil its cleaning purpose there.

This process has, however, proved to be problematic. It is not generally used in practice, and the partly loaded adsorptive agent is disposed of directly, a measure which is distinctly harmful to resources and not environmentally friendly.

Attempts are also made to obtain the driest possible filter cake that can be collected in this way at the separating stage and which, after being appropriately conveyed, can then perhaps be added to the first step in the process. It is always difficult to open up the system while letting in the smallest possible amount of harmful oxygen. That is the reason why such processes either fail or at least give unsatisfactory results.

SUMMARY OF THE INVENTION

The present invention seeks to provide a process and an apparatus for counteracting the above problem.

According to a first aspect of the present invention, there is provided a method of absorptive cleaning of vegetable and/or mineral oils and fats in a multi-stage counter-current process, wherein, in a first step, uncleaned oil or fat is put into contact and pre-cleaned with already used, partly loaded adsorptive agent in a first stage and then fed to a first separating stage where it is pre-separated, and, in a second step, said pre-cleaned and pre-separated oil or at is put into contact with fresh absorptive agent in a second stage and then fed to a second separating stage for a second separation and, after said second separation, is passed on for further processing as a cleaned and/or bleached oil or fat, with constituents removed from said oil or fat, from the second separating stage, being employed as already used, partly loaded adsorptive agent for said first step in the method, wherein said constituents removed from the oil or fat are obtained and/or prepared as a pumpable sludge in said second separating stage, and are passed to said uncleaned oil or fat at said first stage with air excluded.

According to a second aspect of the present invention, there is provided an apparatus for absorptive cleaning of vegetable and/or mineral oils and fats in a multi-stage counter-current process, with said oil or fat to be cleaned being guided in series through a first stage, a first separating stage, a second stage and a second separating stage, for removing constituents from said oil or fat, the cleaned oil or fat being discharged from said second separating stage, a supply of adsorptive agent being provided between said first separating stage and said second stage, and a supply of already used, partly loaded adsorptive agent being provided at said first stage, wherein said second separating stage has an apparatus, said apparatus preparing said removed constituents as a pumpable sludge, and said sludge can be fed through a pipe to said first stage with air excluded.

BRIEF DESCRIPTION OF THE DRAWING

A preferred embodiment of the invention will now be described, by way of example only, with reference to the accompanying drawing, in which:

FIG. 1 is a diagrammatic representation of the method of the invention.

DESCRIPTION OF THE PREFERRED EMBODIMENTS

Basically the invention provides a method of absorptive cleaning of vegetable and/or mineral oils and fats in a multi-stage counter-current process, wherein uncleaned oil or fat is put into contact and pre-cleaned with already used, partly loaded adsorptive agent at a first stage then fed to a first separating stage, whereupon the thus pre-cleaned and pre-separated oil or fat is put into contact with fresh absorptive agent at a second stage then fed to a second separating stage and, after the second separation, is passed on for further processing as a cleaned and/or bleached oil or fat, the constituents removed from the oil or fat, from the second separating stage, being employed as already used, partly loaded adsorptive agent for the first step in the process, wherein the constituents removed from the oil or fat are obtained and/or prepared as a pumpable sludge in the second separating stage, and are passed to the uncleaned oil or fat at the first stage with air excluded.

The invention also provides an apparatus for absorptive cleaning of vegetable and/or mineral oils and fats in a multi-stage counter-current process, with the oil or fat to be cleaned being guided in series through a first stage, a first separating stage, a second stage and a second separating stage, from which the cleaned oil or fat is discharged, a supply of adsorptive agent being provided between the first separating stage and the second stage, and a supply of already used, partly loaded adsorptive agent being provided at the first stage, wherein the second separating stage has an apparatus which prepares the constituent removed as pumpable sludge, and the sludge can be fed through a pipe to the first stage with air excluded.

Thus in arrangements according to the invention, the previously experienced problem is solved in that, instead of making the filter cake as dry as possible and thus perhaps unlikely to be accessed by oxygen, as has hitherto been the aim in all known plants, importance is here attached quite deliberately to having a sludge which is not only moist but even capable of being pumped. The pumpable sludge can in fact be conveyed within the system without any manual intervention, and contact with oxygen can also be absolutely prevented. The system need not in fact be opened anywhere to deal with the filter product or cake in any way. Instead the filter product is pumped back from the second separating stage direct to the very first stage.

The main adsorptive agent considered is clay; this designation will be used hereinafter without implying any restriction to that type of adsorptive agent. It is also possible to use activated carbon and silica gel, e.g. Trisyl, or mixtures; the clay may be natural or activated.

The consistency of the sludge should preferably be specified, as follows: the fluid content is over 30% to ensure that it can be pumped well. It should also be below 80%, as a still higher fluid volume is not necessary and back-mixing of the oil can be kept within limits in this way. The sludge is kept pumpable simply by retaining and re-using more oil at the separating stage and recycling it to the first stage. This is perfectly effective but naturally need not go beyond these limits.

The temperature should as far as possible be above 60° C., as this too is very helpful in allowing the sludge to be pumped. In known processes there is usually an attempt to keep the temperature as low as possible, since when there is contact with air high temperatures of course immediately encourage reaction with harmful oxygen. This risk does not arise in the present invention, so the advantage of high temperature can be exploited without having to accept the simultaneous disadvantage experienced in prior art.

A cartridge filter (or multiple tube or candle filter) or a cartridge pressure filter (or multiple tube pressure filter) is preferably used at the second separating stage. This type is also known by the names of pulse tube filter, (Cricket filter or Contibac filter, from various suppliers.

Alternatively other filters may of course be used as the second separating stage, for example continuously operating filters or hydrocyclones, although these are less preferred.

Filter product release is preferably discontinuous, the filter product (or the filter sludge or sludge—see above) being buffered in the filter so that an additional container is not required. Material is discharged from the second separating stage with continuous metering; the continuous flow may, if necessary, be interrupted each time a filter product is released, in order to avoid disturbances and other effects.

This continuous feeding of the filter cake/filter sludge takes it direct to the first stage, to the uncleaned oil or fat.

The metering may additionally be controlled, for example so that part of the second separating stage, e.g. a cone, is emptied between every two releases of filter product. This may be done simply by ascertaining the amount of filter product in the cone then appropriately emptying it with time-dependent metering.

Such a control can prevent two unfavourable eventualties: if too little sludge were carried away the filter would fill up more with sludge each time a product was released; whereas if too much filter cake/filter sludge were carried away, there would be no sludge left in the filter before the next product release, that is to say, continuous discharge would be put at risk and there would be a gap in the pre-cleaning process. Although such gaps would not threaten the whole operation of the system, they would make it less reliable.

A plate filter or Niagara filter may be employed in the first separating stage and operated in conventional manner.

It is further preferable for acid, especially phosphoric or citric acid, to be mixed in. The addition of acid may be supplemented by a further addition of water. The maximum amount of actual acid should be 3000 ppm, the maximum amount of water 0.6%.

The addition of acid and water improves filtration in the filters but also improves the cleaning or bleaching effect. It takes place before the first stage in particular, i.e. before the first clean or bleach.

The purpose of the process will first be explained, to make the diagram easier to understand. Thus, referring to the drawing, uncleaned oil 1 or fat is fed in, is treated in the plant as described below, and leaves the process as cleaned, bleached oil 2 or fat. The oils and fats referred to here and elsewhere in the specification may be any vegetable and/or mineral ones; the method can be applied to numerous different oils and fats.

Fresh clay 3 (or a different adsorptive agent) must be supplied for the cleaning process; after a plurality of steps in the process it similarly leaves the process as a loaded adsorptive agent 4, together with the unwanted substances accompanying or contained in the oil or fat, e.g. colorants.

Various steps in the process have to be carried out below atmospheric pressure and with air excluded, and a vacuum 5 therefore has to be applied; the various steps take place with steam 6 supplied, and in preferred embodiments water and/or acid 8 is added.

The uncleaned oil 1 (or fat) is fed to a first stage 11, possibly together with an acid 8. At that first stage 11 it is put into contact with aleady used, partly loaded adsorptive agent; a motor M provides vigorous mixing, and steam 6 is supplied to maintain a constant oil temperature. The details of stage 11 correspond to normal practice; an agitator and various baffles are provided. The falling action allows the partly loaded adsorptive agent to pick up from the very impure oil fluid corresponding impurities or colorants which are released from the oil in this way. The whole mixture is then discharged from stage 11 by a pump 12 and transferred to a first separating stage, to the right in FIG. 1. To ensure even, continuous operation, the first separating stage has two filters 15 and 16 which are connected in parallel and work alternately; whenever one of the two filters 15 or 16 has to be cleaned, the other one is in operation.

The filters 15, 16 at the first separating stage filter the now very loaded adsorptive agent out of the mixture supplied, together with all the unwanted substances and colour constituents accompanying the oil, and collect them in receiving tanks 17 (indicated diagrammatically). The filters 15 and 16 may, for example, be Niagara or plate filters.

The oil or fat is now pre-cleaned and leaves the first separating stage 15, 16 as such—shown as 18. Again acid 8 or water may possibly be supplied. The now pre-cleaned oil 18 is mixed with fresh adsorptive agent 3 in an agitator 23, after which the mixture is fed from the agitator 23 to the second stage 21. Here again steam 6 is supplied to maintain a constant oil temperature, and vacuum 5 is applied both in the agitator 23 and in the second stage 21. The mode of operation of the second stage 21 is basically similar to that at the first stage 11. Here too the falling action enables the fresh adsorptive agent 3 effectively to remove the colorants and accompanying substances still contained in the pre-cleaned oil 18. The mixture is passed on again by the pump 22 and fed to a second separating stage 25 as a mixture 28 of relatively well-cleaned oil and adsorptive agent with the corresponding loads and colour particles.

This second separating stage 25 is the essential part of the plant and the invention. It has a cartridge filter or a cartridge pressure filter, known in the trade as a pulse tube filter, Cricket filter or Contibac filter. These filters are provided with a cone at the bottom. The filter cake, which comprises loaded adsorptive agent and oil and which forms on the filter fabric, is released discontinuous from the cartridges. It is released in such a way that the resultant filter cake is still in sludge form, that is to say, still contains a relatively large proportion of oil compared to the state of the art. This fluid content is between 30% and 80% of the filter sludge formed. The sludge drops down into the cone and fills it to a certain level. The filling level is sensed by suitable sensors, which thereby provide appropriate information on the filling state. Dependent on the filling state they control the speed at which the filter sludge or cake 29 is continuously advanced. Tie cake is in fact fed constantly and in metered fashion from the cone at the second separating stage 25 to the first stage 11 and the uncleaned oil 1 or fat supplied thereto, i.e. it is fed to the beginning of the process. The sludge is employed as the used, partly loaded adsorptive agent 29 already mentioned above and is mixed with the uncleaned oil. The process then continues with it.

The continuous supply of partly loaded adsorptive agent from the second separating stage 25 to the first stage 11 can be interrupted temporarily without disturbing the process, for example if no disturbances must be allowed to reach the first stage through the pipe while the filter product is being released. If the supply of sludge is interrupted for a fairly short period this has hardly any effect on the actual cleaning process.

The filling level in the cone at the second separating stage 25 moves periodically between 0% and 100%. It is approximately 0% immediately before a filter product is released, that is to say, when the product from the previous filter cleaning has been pumped to stage 11. The filling level is 100% immediately after the product is released.

The fully cleaned oil or fat then leaves the second separating stage 25 at 2 after being filtered.

It will be understood that the above description of the present invention is susceptible to various modifications, changes and adaptations.

What is claimed is:

1. A method of absorptive cleaning of vegetable and/or mineral oils and fats in a multi-stage counter-current process, wherein, in a first step, uncleaned oil or fat is put into contact and pre-cleaned with already used, partly loaded adsorptive agent in a first stage and then fed to a first separating stage where it is pre-separated, and, in a second step, said pre-cleaned and pre-separated oil or fat is put into contact with fresh absorptive agent in a second stage and then fed to a second separating stage for a second separation and, after said second separation, is passed on for further processing as a cleaned and/or bleached oil or fat, with constituents removed from said oil or fat, from the second separating stage, being employed as already used, partly loaded adsorptive agent for said first step in the method, wherein said constituents removed from the oil or fat are obtained and/or prepared as a pumpable sludge in said second separating stage, and are passed to said uncleaned oil or fat at said first stage with air excluded.

2. The method of claim 1, wherein said sludge at the second separating stage has a fluid content of over 30%.

3. The method of claim 2, wherein said fluid content is less than 80%.

4. The method of claim 1, wherein said sludge at said second separating stage has a temperature of over 60° C.

5. The method of claim 1, wherein a filter is employed in said second separating stage to produce a filter product.

6. The method of claim 5, wherein discontinuous release of said filter product into a cone at the bottom of said filter takes place at said second separating stage, said cone being emptied continuously with interruptions while said product is being released.

7. The method of claim 1, wherein acid is added to the process.

8. The method of claim 7, wherein the amount of acid added is less than 3000 ppm.

9. The method of claim 7, wherein said acid employed is phosphoric or citric acid.

10. The method of claim 7, wherein the addition of acid takes place before said first stage or after said first separating stage.

11. The method of claim 7, wherein water is also added.

12. The method of claim 11, wherein the addition of water takes place before said first stage or after said first separating stage.

13. An apparatus for absorptive cleaning of vegetable and/or mineral oils and fats in a multi-stage counter-current process, with said oil or fat to be cleaned being guided in series through a first stage, a first separating stage, a second stage and a second separating stage, for removing constituents from said oil or fat, the cleaned oil or fat being discharged from said second separating stage, a supply of adsorptive agent being provided between said first separating stage and said second stage, and a supply of already used, partly loaded adsorptive agent being provided at said first stage, wherein said second separating stage has an apparatus, said apparatus preparing said removed constituents as a pumpable sludge, and said sludge can be fed through a pipe to said first stage with air excluded.

14. The apparatus of claim 13, wherein said second separating stage comprises a cartridge filter or a cartridge pressure filter.

* * * * *